US010230188B2

(12) United States Patent
Blanchet et al.

(10) Patent No.: US 10,230,188 B2
(45) Date of Patent: Mar. 12, 2019

(54) ELECTRICAL CONNECTOR COMPRISING A HEAT DISSIPATOR AND ELECTRICAL APPARATUS EQUIPPED WITH SUCH A CONNECTOR

(71) Applicant: SCHNEIDER ELECTRIC INDUSTRIES SAS, Rueil-Malmaison (FR)

(72) Inventors: Matthieu Blanchet, Amberieu en Bugey (FR); Patricia Spezzatti, La Terrasse (FR); Christophe Kilindjian, Meylan (FR); Eric Domejean, Voreppe (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 81 days.

(21) Appl. No.: 15/296,607

(22) Filed: Oct. 18, 2016

(65) Prior Publication Data

US 2017/0162968 A1 Jun. 8, 2017

(30) Foreign Application Priority Data

Dec. 2, 2015 (FR) ..... 15 61754

(51) Int. Cl.

| | |
|---|---|
| ***H01R 13/00*** | (2006.01) |
| ***H01R 13/02*** | (2006.01) |
| ***H01H 1/58*** | (2006.01) |
| ***H01R 4/28*** | (2006.01) |
| ***H01R 13/03*** | (2006.01) |
| *H01H 9/52* | (2006.01) |
| *H01R 31/08* | (2006.01) |

(Continued)

(52) U.S. Cl.

CPC ..... *H01R 13/02* (2013.01); *H01H 1/58* (2013.01); *H01R 4/28* (2013.01); *H01R 13/03* (2013.01); *H01H 9/52* (2013.01); *H01H 71/08* (2013.01); *H01R 31/08* (2013.01); *H01R 2101/00* (2013.01)

(58) Field of Classification Search

CPC ..... H01R 13/02; H01R 4/28; H01R 13/03; H01R 31/08; H01R 2101/00; H01H 1/58; H01H 9/52; H01H 71/08

USPC ..... 439/485–487

See application file for complete search history.

(56) References Cited

U.S. PATENT DOCUMENTS

| | | | |
|---|---|---|---|
| 2002/0122289 | A1 | 9/2002 | Meiners et al. |
| 2006/0245987 | A1 | 11/2006 | Schmidt |
| 2008/0044621 | A1 | 2/2008 | Strauss |

(Continued)

FOREIGN PATENT DOCUMENTS

| | | |
|---|---|---|
| CN | 204011306 | 12/2014 |
| CN | 204011306 U | 12/2014 |

(Continued)

OTHER PUBLICATIONS

French Preliminary Search Report dated Jun. 1, 2016 in French Application 15 61754, filed on Dec. 2, 2015 ( with English Translation of Categories of Cited Documents).

*Primary Examiner* — Khiem Nguyen

(74) *Attorney, Agent, or Firm* — Oblon, McClelland, Maier & Neustadt, L.L.P.

(57) ABSTRACT

An electrical connector including a conduction portion having two terminals intended to be each connected electrically to a connection terminal of an electrical apparatus, the connector further including a dissipation portion of the same (Continued)

material as the conduction portion and having a cellular structure defining a plurality of cells.

13 Claims, 4 Drawing Sheets

(51) Int. Cl.
*H01R 101/00* (2006.01)
*H01H 71/08* (2006.01)

(56) References Cited

U.S. PATENT DOCUMENTS

| | | | |
|---|---|---|---|
| 2012/0106033 | A1 | 5/2012 | Kasza et al. |
| 2013/0032322 | A1 | 2/2013 | Hsu |

FOREIGN PATENT DOCUMENTS

| | | | |
|---|---|---|---|
| DE | 100 55 454 | A1 | 5/2002 |
| EP | 2 280 460 | A1 | 2/2011 |
| WO | WO 2007/149535 | A1 | 12/2007 |
| WO | WO 2013/143657 | A1 | 10/2013 |

ELECTRICAL CONNECTOR COMPRISING A HEAT DISSIPATOR AND ELECTRICAL APPARATUS EQUIPPED WITH SUCH A CONNECTOR

The present invention relates to an electrical connector and a circuit breaker equipped with such a connector.

Circuit breakers intended for low-voltage alternating currents usually comprise a plurality of poles, frequently three or four poles. Each pole is capable of receiving, on an input connection area, a phase of the alternating current or the neutral, and to deliver the phase, in normal operation, on an output area. The circuit breaker is also capable of isolating the input area from the output area if necessary; that is to say, it is capable of blocking the flow of the current across the pole.

A circuit breaker of this type has a non-negligible resistance to the flow of current, which may result in considerable heating of its internal components. Most of the heat generated is dissipated in the wires electrically connected to the input and output areas, so that the wires act as heat dissipaters because of their high thermal conductivity and considerable length.

Circuit breakers of this type are used for direct current applications with a voltage of up to 1500 volts. For example, photovoltaic solar energy sources supply d.c. voltages that may be as much as 1500 volts (V) or thereabouts. However, the poles of these circuit breakers are unsuitable for voltages in excess of about 500 V. In order to use these circuit breakers at a higher voltage, different poles are usually connected in series, using electrical connectors. The voltage is then distributed over a plurality of poles of the circuit breaker, each pole being subject to a voltage of not more than 500 V.

Such electrical connectors often have a shape resembling the letter U, and can be used for the electrical connection of the input (or output) areas of two neighbouring poles.

If such a configuration is used, the dissipation of the heat generated in the circuit breaker becomes more difficult at the position of the connectors. This is because each pole, instead of being connected to an electrical wire acting as a heat dissipater, is connected to at least one other pole in which the electric current causes heating. The risk of damage to the circuit breaker by overheating is therefore increased.

To counteract these effects, the connectors that are used are commonly equipped with cooling devices such as fins, which increase the exchange surface area between the connector and the atmosphere.

However, the cooling devices that are used are not very efficient. In particular, the cooling devices that are used are not suitable for all possible orientations of the circuit breaker, since their fins have to be arranged vertically in order to maximize the convective exchanges with the atmosphere.

The object of the invention is to propose an electrical connector for connecting two poles of circuit breaker in series which has a higher efficiency in terms of heat dissipation.

For this purpose, the invention proposes an electrical connector comprising a conduction portion comprising two terminals intended to be each connected electrically to a connection terminal of an electrical apparatus, the connector further comprising a dissipation portion of the same material as the conduction portion and having a cellular structure defining a plurality of cells.

According to other advantageous aspects of the invention, the connector comprises one or more of the following characteristics, considered separately or in all technically feasible combinations:

- the dissipation portion has a porosity greater than or equal to 50%, preferably equal to 75%, or more preferably equal to 85%;
- the conduction portion is made at least partially of metal, preferably aluminium;
- the connector comprises a core made of a first material having a first emissivity, while the dissipation portion comprises a passivation layer made of a second material having a second emissivity which is greater than or equal to, and preferably strictly greater than, the first emissivity;
- each cell is adapted to be traversed by a first flow of fluid orientated in a first direction;
- each cell is adapted to be traversed by the first flow and by a second flow of fluid orientated in a second direction perpendicular to the first direction;
- each cell is connected to at least one other cell via an opening allowing a fluid to flow from one cell to the other;
- the dissipation portion delimits a first set of cells of a first type and a second set of cells of a second type, the cells of the first type being cylindrical with octagonal bases, while the cells of the second type are cylindrical with square bases;
- the first set comprises a plurality of first subset of cells of the first type, and the second set comprises a plurality of second subsets of cells of the second type, each first subset and each second subset having its respective intrinsic line, the cells of each subset being arranged along the intrinsic line of the subset and the axis of each cell being the intrinsic line;
- the cells take the form of truncated octahedra.

The invention also proposes an electrical apparatus, notably a circuit breaker, equipped with a connector as defined above.

The characteristics and advantages of the invention will be apparent from a perusal of the following description, provided solely by way of non-limiting example with reference to the attached drawings, in which.

Figure 1:
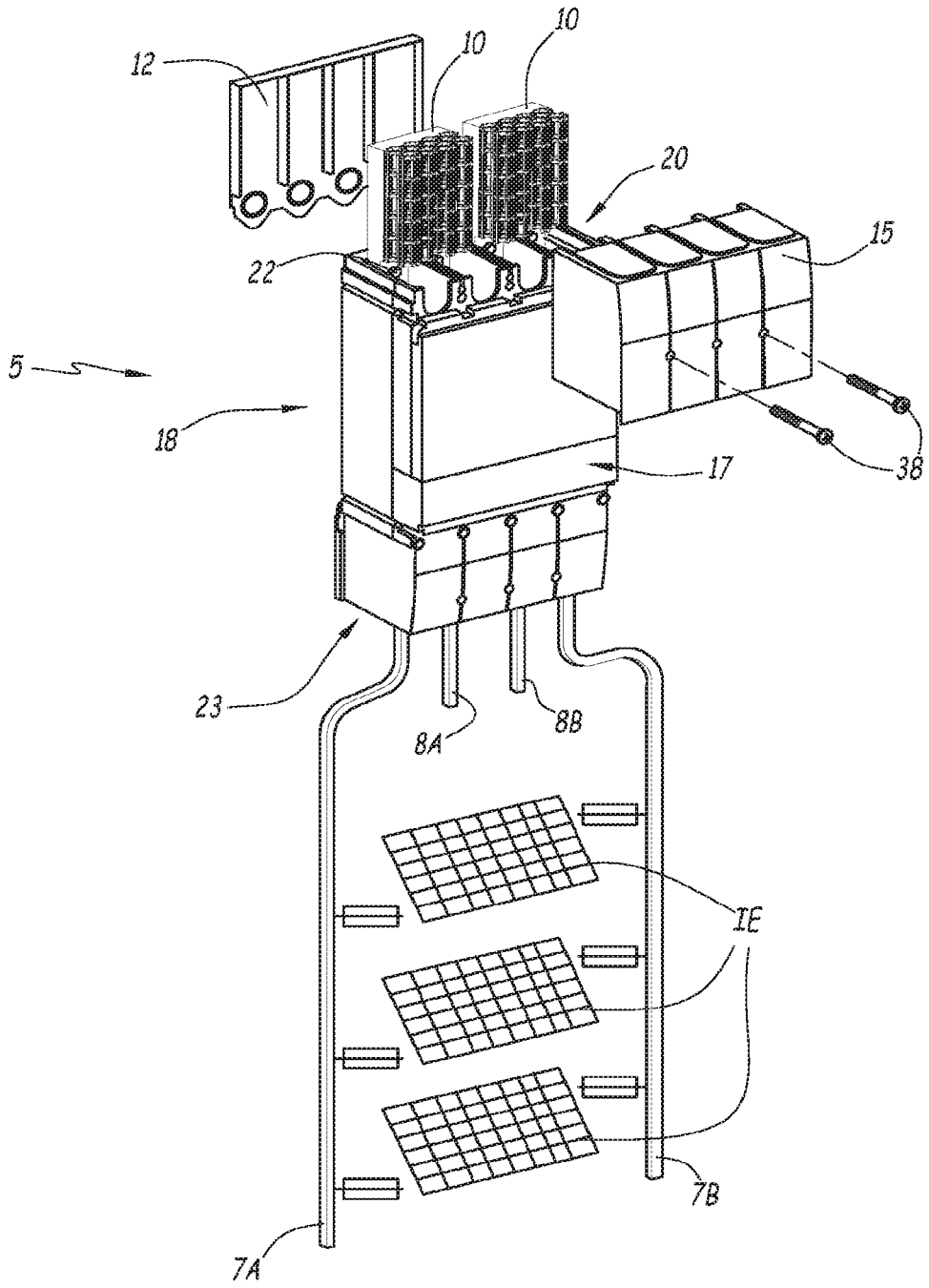
FIG. 1 is an exploded perspective view of a circuit breaker equipped with two connectors according to the invention.

An electrical apparatus 5 equipped with two input conductors 7A, 7B, two output conductors 8A, 8B, two connectors 10, a rear base 12 and a cover 15 is shown in FIG. 1.

The electrical apparatus 5 is, for example, a circuit breaker, such as an electromechanical circuit breaker.

The circuit breaker 5 has a generally parallelepipedal shape.

The circuit breaker 5 has a front face 17, a rear face (not shown), two side faces 18 of which only one is visible on the left of FIG. 1, and two terminal faces 20, of which only the upper face is visible in the upper part of FIG. 1.

The circuit breaker 5 has a plurality of poles. Each pole comprises a primary connection area 22 and a secondary connection area 23.

Each pole is configured to receive an electric current I on the primary area 22 and to deliver the current I on the secondary area 23, and vice versa.

Each area 22, 23 is adapted to receive an end of a conductor 7A, 7B, 8A, 8B.

Each primary connection area 22 is carried by a first terminal face 20, namely the upper face. Each secondary connection area 23 is carried by the second terminal face 20, namely the lower face.

Two connectors 10 are mounted on the upper terminal face 20, each of these connectors interconnecting two primary connection areas 22.

Each input conductor 7A, 7B is an electrical wire connected electrically to a plurality of electrical installations IE.

In FIG. 1, each input conductor 7A, 7B is connected electrically to three electrical installations IE, for example three photovoltaic electricity generation installations.

Each installation IE is connected electrically to the first input conductor 7A and to the second input conductor 7B. Preferably, each electrical installation IE is adapted to create a potential difference between the first input conductor 7A and the second input conductor 7B.

Each output conductor 8A, 8B is an electrical wire connected to an electricity distribution network (not shown).

The invention is described above with reference to the case in which it is used to interconnect electrically two primary connection areas 22 of the upper terminal face 20. However, it can equally well be used to interconnect electrically two secondary connection areas 23 of the lower terminal face 20.

Figure 2:
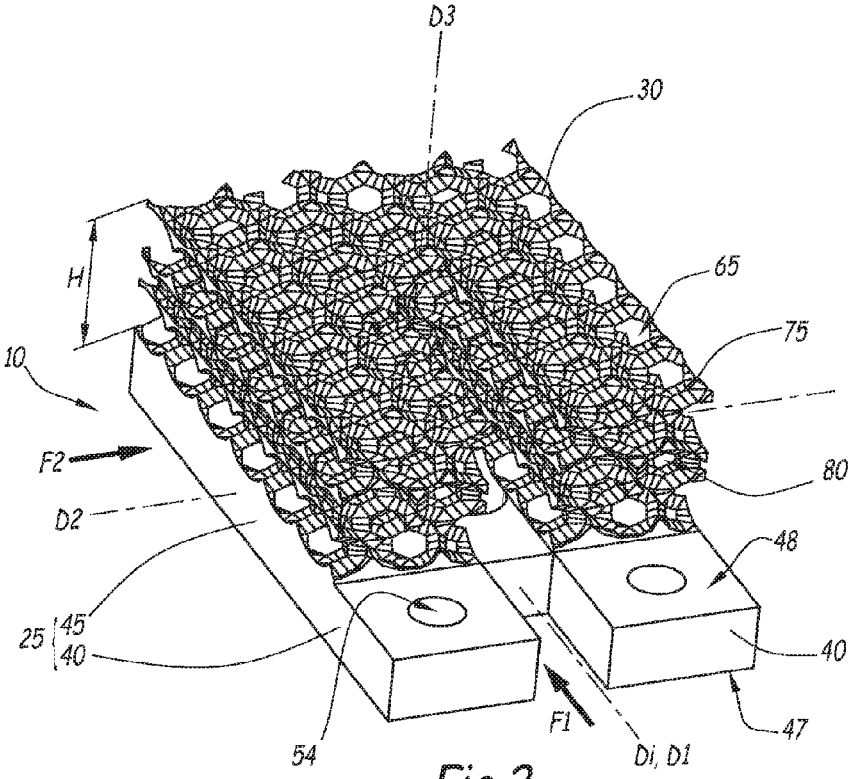
FIG. 2 is a top view, in perspective, of a connector of the circuit breaker of FIG. 1.
Figure 3:
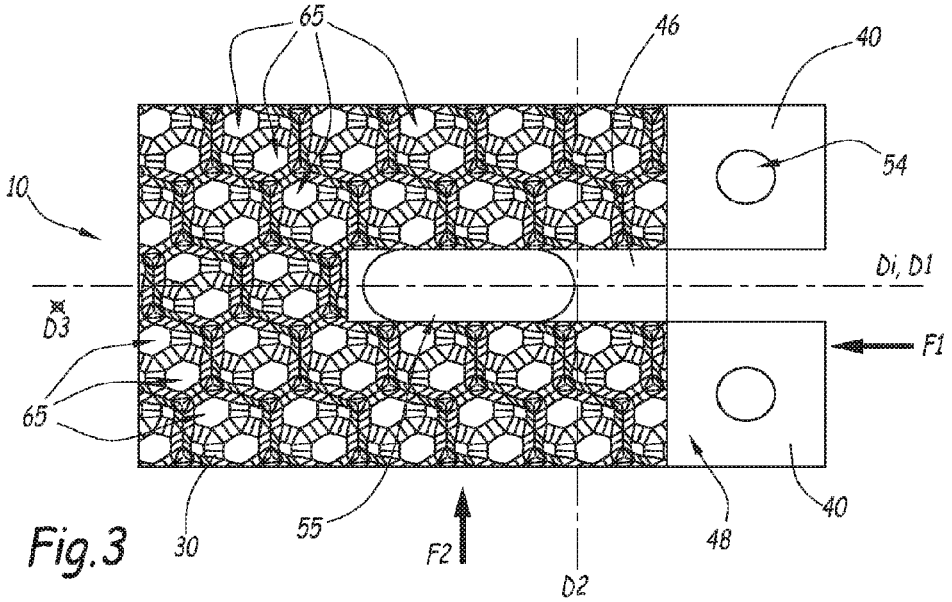
FIG. 3 is a top view of the connector of FIG. 2.

A first example of a connector 10 is shown in FIGS. 2 and 3.

This connector 10 is movable with respect to the circuit breaker 5 between a disconnection position and at least one connection position. Preferably, the connector 10 is movable translationally along a direction of insertion Di between the connection position and the at least one disconnection position.

The connector 10 is configured to connect electrically two neighbouring primary connection areas 22 or two neighbouring secondary connection areas 23 of the circuit breaker 5 when the connector 10 is in the connection position.

The connector 10 is also adapted to cool the circuit breaker 5 by heat exchange with the atmosphere. For example, the connector 10 is adapted to cool the circuit breaker 5 by spontaneous heat exchange with the atmosphere, notably by convection. In a variant, the connector 10 is adapted to cool the circuit breaker 5 by forced heat exchange with the atmosphere, for example by using a fan to direct an air flow towards the connector 10.

The connector 10 comprises a conduction portion 25, a conduction layer, a passivation layer and a dissipation portion 30.

The connector 10 is made in one piece. This means that the conduction portion 25 and the dissipation portion 30 have a common core.

The conduction portion 25 comprises two terminals 40 and a body 45.

The conduction portion 25 has a first face 47 and a second face 48 opposite the first face 47. Preferably, the first face 47 and the second face 48 are parallel.

When the connector 10 is in the connection position, the second face 48 is orientated towards the front face 17. Preferably, the second face 48 is substantially parallel to the front face 17.

The cover 15 is attached removably to the circuit breaker 5.

The cover 15 is adapted to prevent access by an operator to the connectors 10 when the cover 15 is attached to the circuit breaker 5 and the connectors 10 are in the connection position.

The rear base 12 and the cover 15 are configured so that, when they are attached to each other, they cover each connector 10 at least partially. The rear base 12 and the cover 15 are, for example, attached to each other by a first screw 38.

The conduction portion 25 is adapted to receive the current I at one of the terminals 40, and to deliver the electric current to the other terminal 40.

The core is also common to the body 45 and to the terminals 40.

The core is made of a first material M1. The first material M1 is electrically and thermally conductive. Preferably, the first material M1 is a metallic material.

The first material M1 is advantageously aluminium. In a variant, the first material M1 is copper. In another variant, the first material M1 is nickel. The first material M1 has a first emissivity $\varepsilon 1$ with a value of between 0.02 and 0.9.

The emissivity of a material is defined as the ratio between the energy radiated by the material and the energy radiated by a black body at the same temperature.

Each terminal 40 is adapted to be connected electrically to a connection area 22, 23 when the connector 10 is in the connection position.

When the connector 10 is in the disconnection position, its terminals 40 are not connected electrically to an area 22, 23.

Each terminal 40 is parallelepipedal. Each terminal 40 has a hole 54 for receiving a second attachment screw (not shown). The second screw is adapted to attach the terminal 40 to the area 22, 23 when the connector 10 is in the connection position.

The body 45 is adapted to conduct the electric current I between a terminal 40 and the other terminal 40.

The body 45 is parallelepipedal.

The body 45 has a hole 55 for the passage of the first screw 38. The passage hole 55 is cylindrical about an axis perpendicular to the first face 47. As can be seen in FIG. 3, the passage hole 55 is cylindrical with an oval base.

The conduction layer is adapted to protect the core of the terminal 40 from corrosion. The conduction layer is also adapted to provide a good electrical connection between the core and the connection terminal 22, 23.

The conduction layer covers at least a part of the core of the terminal 40. Preferably, the conduction layer covers the whole of the core of the terminal 40.

The conduction layer is made of an electrically conductive material. For example, the conduction layer is made of a metallic material such as silver. In a variant, the conduction layer is made of tin.

The conduction layer has a first thickness e1. The first thickness e1 is between 500 nanometers and 50 micrometers, being, for example, equal to 15 micrometers (μm).

The passivation layer is adapted to protect the core of the body 45 and the core of the dissipation portion 30 from corrosion. The passivation layer is also adapted to increase the heat exchange of the dissipation portion 30 with the atmosphere by radiation, by comparison with the same dissipation portion 30 without a passivation layer.

The passivation layer covers at least a part of the core of the body 45 and the core of the dissipation portion 30. Preferably, the passivation layer covers the whole of the core of the body 45 and the core of the dissipation portion 30.

The passivation layer is made of a second material M2.

The second material M2 is electrically insulating.

The second material M2 has a second emissivity ε2. The second emissivity ε2 is greater than or equal to the first emissivity ε1. Preferably, the second emissivity ε2 is strictly greater than the first emissivity ε1.

In particular, the second emissivity ε2 is between 0.6 and 0.9.

Preferably, the second emissivity ε2 is greater than or equal to 0.75, or preferably 0.85.

The second material M2 is advantageously alumina, $Al_2O_3$. For example, if the core is made of aluminium, the layer of second material M2 is produced by anodizing.

The layer of second coating has a second thickness e2. The second thickness e2 is between 5 μm and 20 μm.

In a variant, the second material M2 is a polymer material having a second emissivity ε2 strictly greater than the first emissivity ε1, such as a matt black polymer material. The second material M2 is, for example, a polyurethane, preferably a two-component polyurethane produced by curing an isocyanate. In this case, the second thickness e2 is strictly less than 1 millimeter (mm).

The dissipation portion 30 is adapted to increase the loss of heat energy by conduction, convection and radiation, by comparison with the same connector 10 without a dissipation portion 30.

The dissipation portion 30 is adapted to be traversed by a first flow F1 of a fluid F and by at least a second flow F2 of the fluid F.

The fluid F is air, for example.

The first flow F1 and the second flow F2 are, for example, spontaneous flows, such as convective flows or flows generated by the wind. In a variant, the first flow F1 and the second flow F2 are generated artificially, by a fan for example.

The first flow F1 is orientated in a first direction D1. For example, the first direction D1 is parallel to the direction of insertion Di.

The second flow F2 is orientated in a second direction D2. The second direction D2 is perpendicular to the first direction D1.

For example, the first direction D2 is parallel to the second face 48.

The dissipation portion 30 has a cellular structure. This means that the dissipation portion 30 defines a plurality of cells 65.

The dissipation portion 30 has a height H in a third direction D3. The height H is shown in FIG. 2. The third direction D3 is perpendicular to the second face 48. Preferably, the third direction D3 is also perpendicular to the direction of insertion Di.

The height H is less than or equal to 45 millimeters (mm). For example, the height H is equal to about 30 mm. The expression "equal to about 30 mm" is taken to mean that the height H is equal to 30 mm with a tolerance of 10 percent.

The dissipation portion 30 and the body 45 are superimposed in a third direction D3.

Each cell 65 has an individual volume Vi.

A total volume Vt is defined as the sum of the individual volumes Vi of each cell 65.

The dissipation portion 30 has a first volume V1. The first volume V1 is defined as the volume of material making up the dissipation portion 30. That is to say, the first volume V1 is the sum of the volume of the core of the dissipation portion 30, the volume of the passivation layer, and the total volume Vt. A porosity P is defined for the dissipation portion 30. The porosity P is defined as the ratio between, on the numerator, the total volume Vt of the cells 65, and, on the denominator, the first volume V1. In mathematical terms, this is written:

$$P = \frac{Vt}{V1}$$

The porosity P is greater than or equal to 50 percent (%). The porosity P is advantageously strictly greater than 75%, or preferably greater than or equal to 85%.

For example, the dissipation portion 30 is formed by the combination of a plurality of segments 75.

Each segment 75 is substantially rectilinear.

Each segment 75 is connected to at least another segment 75. For example, the segment 75 is connected at one of its ends to the other segment 75.

Each cell 65 is polyhedral in shape.

A polyhedron is a three-dimensional geometrical shape having polygonal flat faces which meet along segments of straight line, called edges.

For example, each cell 65 is delimited by a primary subset SE1 of segments 75, and the combination of the segments 75 of the primary subset SE1 forms a polyhedron of which each segment 75 forms an edge.

Each face of the cell 65 is defined by a secondary subset SE2 of segments 75.

In FIG. 2, the cell 65 takes the form of a truncated octahedron. The truncated octahedron is a polyhedron having 8 regular hexagonal faces, 6 regular square faces, 24 vertices and 36 edges.

Each cell 65 has at least one opening 80. For example, the opening 80 is delimited by the secondary subset SE2 of segments 75.

The opening 80 is adapted to interconnect a first cell 65 and a second cell 65.

For example, the first cell 65 is delimited by a first primary subset SE1, the second cell 65 is delimited by a second primary subset SE1, and the secondary subset SE2 is included in both the first primary subset SE1 and the second primary subset SE1.

The opening 80 is configured to allow the fluid F to flow from the first cell 65 to the second cell 65. The openings 80 therefore allow heat to be conducted within the cellular structure.

Each opening 80 has a diameter D.

The diameter D of an opening 80 is the diameter of the circle inscribed in this opening 80. In geometry, a circle inscribed in a polygon is a circle which is internally tangent to all the sides of the polygon. More generally, the expression "a circle inscribed in a bounded surface" signifies a circle of the largest possible radius included in the surface.

The diameter D is, for example, strictly in the range from 6 mm to 10 mm.

For example, the first cell 65 has at least a first opening 80 and a second opening 80. This means that the cell 65 is connected to at least the second cell 65 and a third cell 65.

The cell 65 is adapted to be traversed by a flow of the fluid F. This means that the first opening 80 is formed in a first face of the first cell 65 and the second opening 80 is formed in a second face, distinct from the first face.

Preferably, the first face and the second face are parallel to each other.

Advantageously, the first face and the second face are positioned face to face. This means that a straight line connecting the centre of the first face to the centre of the second face is perpendicular to the first face and to the second face.

For example, the straight line connecting the centre of the first face to the centre of the second face is parallel to the first direction D1. This means that the cell 65 is adapted to be traversed by the first flow F1.

The cell 65 also has a third opening 80 and a fourth opening 80. This means that the cell 65 is connected to at least two other cells 65 in addition to the second and third cells mentioned above.

The third opening 80 is formed in a third face, and the fourth opening 80 is formed in a fourth face opposite the third face.

For example, the straight line connecting the centre of the third face to the centre of the fourth face is parallel to the second direction D2. This means that the cell 65 is adapted to be traversed by the second flow F2.

Preferably, each face of the cell 65 has an opening 80.

Thus the connector 10 provides more efficient heat dissipation than the prior art connectors, by simultaneous conduction, convection and radiation.

Furthermore, since the heat dissipation is more efficient, the connector 10 is made of aluminium, which is more electrically resistive but less expensive and lighter than the materials used in the prior art connectors.

Finally, the connector 10 provides efficient heat dissipation even when the circuit breaker 5 is not vertical. For example, the connector 10 provides efficient heat dissipation when the first direction D1 is not a vertical direction. The connector 10 is therefore more adaptable to the conditions of installation of the circuit breaker 5 than the prior art connectors.

Figure 4:
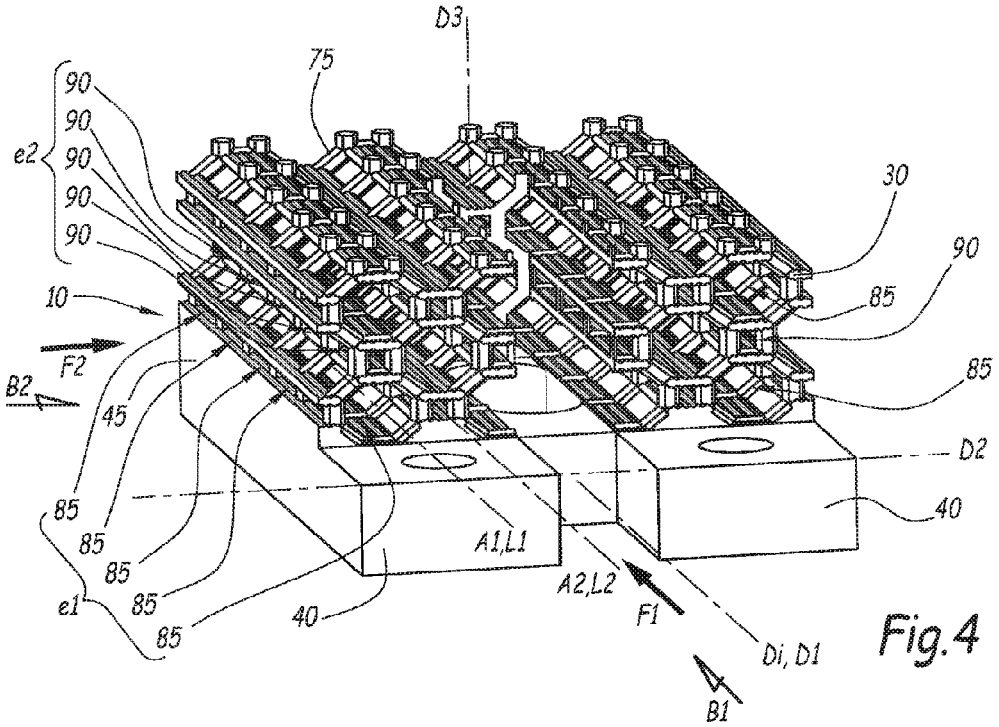
FIG. 4 is a perspective view of a connector according to a second embodiment of the invention.
Figure 5:
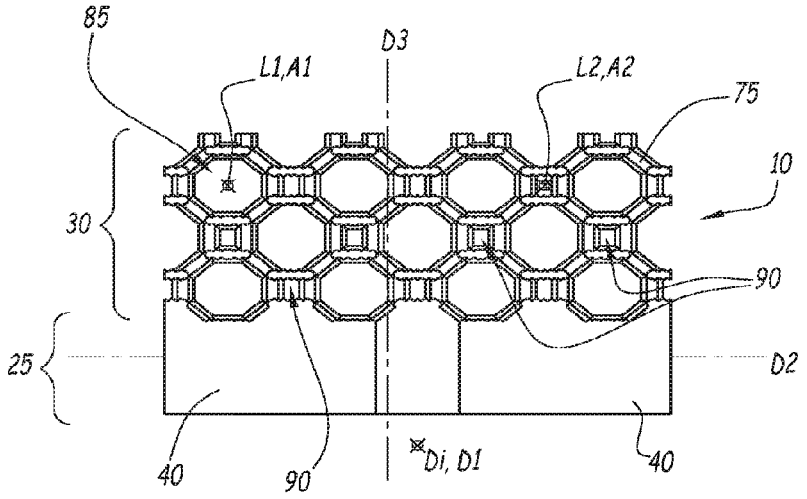
FIG. 5 is a front view taken in the direction of the arrow B1 of the connector of FIG. 4.
Figure 6:
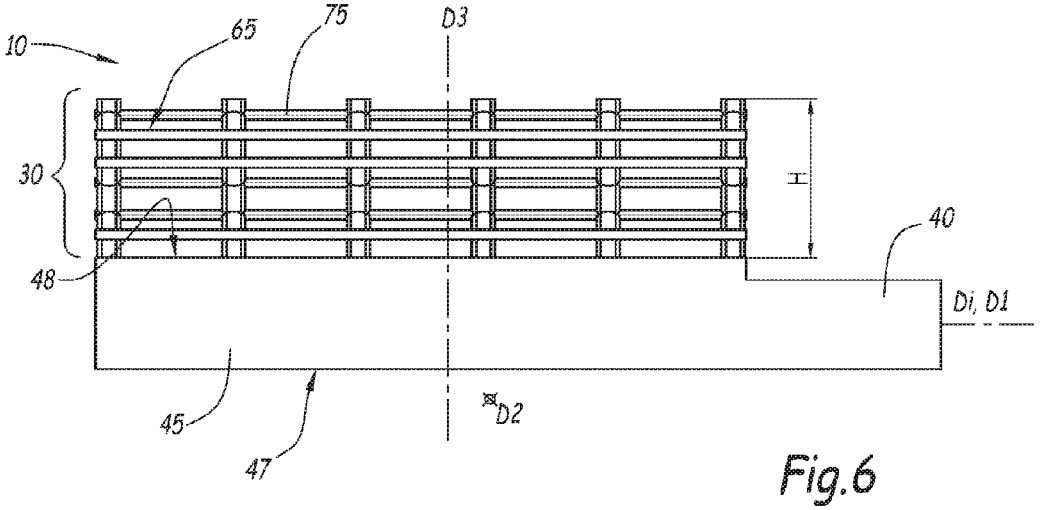
FIG. 6 is a side view taken in the direction of the arrow B2 of the connector of FIG. 4.

A second example of a connector 10 is shown in FIGS. 4 to 6.

Elements identical to those of the first example of a connector shown in FIG. 2 are not described again. Only the differences are indicated.

The dissipation portion 30 delimits a first set of cells 85 of a first type and a second set of cells 90 of a second type.

The first set is formed by the combination of a plurality of first subsets e1 of cells of the first type 85.

Each first subset e1 has a first intrinsic line L1. The first intrinsic line L1 is rectilinear. The first intrinsic line L1 is parallel to the first direction D1.

The cells of the first type 85 of each first subset e1 are aligned with each other along the first intrinsic line L1. For example, each cell of the first type 85 is cylindrical about a first axis A1, and the first axis A1 coincides with the first intrinsic line L1.

The cell of the first type 85 is cylindrical with an octagonal base. The base of the cell of the first type 85 is a regular octagon.

As can be seen in FIG. 5, the cells of the first type 85 form, in a plane perpendicular to the first direction D1, a first periodic network with a square base.

Each cell of the first type 85 is defined, along the second direction D2, by at least one cell of the second type 90. Preferably, the cell of the first type 85 is defined along the second direction D2 by two cells of the second type 90.

Each cell of the first type 85 is defined along the second direction D3 by at least one cell of the second type 90. Preferably, the cell of the first type 85 is defined along the third direction D3 by two cells of the second type 90.

Two edges of the cell of the first type 85 are parallel to the second direction D2, and two edges are perpendicular to the second direction D2.

The base of the cell of the first type 85 defines a terminal face. The terminal face has a terminal opening. The diameter of the terminal opening is, for example, strictly less than 10 mm.

The second set comprises a plurality of second subsets e2 of cells of the second type 90.

Each second subset e2 has a second intrinsic line L2.

The second intrinsic line L2 is rectilinear. The second intrinsic line L2 is parallel to the first direction D1.

The cells of the second type 90 of each second subset e2 are aligned with each other along the second intrinsic line L2. For example, each cell of the second type 90 is cylindrical about a second axis A2, and the second axis A2 coincides with the first intrinsic line L2.

The cell of the second type 90 is cylindrical with a square base.

The cells of the second type 90 form, in a plane perpendicular to the first direction D1, a second periodic network with a square base.

Each cell of the second type 90 is defined, along the second direction D2, by at least one cell of the first type 85. Preferably, the cell of the first type 90 is defined along the second direction D2 by two cells of the second type 85.

Each cell of the second type 90 is defined along the third direction D3 by at least one cell of the first type 85. Preferably, the cell of the second type 90 is defined along the third direction D3 by two cells of the first type 85.

Preferably, the cell of the second type 90 is defined along a plane perpendicular to the first direction D1 by four cells of the first type 85 with which it shares its edges.

The openings of the cells of the two types 85, 90 are aligned along the first direction D1 and along the second direction D2. The pressure drops during the passage of the first flow F1 and the second flow F2 through the dissipation portion are therefore smaller than for a dissipation portion according to the first example de FIG. 2. The heat exchange between the dissipation portion and the atmosphere is therefore improved. The second example of a connector 10 therefore provides more efficient heat dissipation than the first example of a connector 10, in particular when the second direction D2 is a vertical direction.

The invention is described above in the case of its use for a circuit breaker. However, it can be applied to other types of electrical apparatus, notably low-voltage protection and control apparatus.

The invention claimed is:

1. An electrical connector, comprising:

a conduction portion including two terminals and a dissipation portion, wherein the two terminals are electrically connectable to a connection terminal of an electrical apparatus, the dissipation portion is of the same material as the conduction portion, the dissipation portion has a cellular structure including a plurality of cells, and each cell of the plurality of cells is configured to be traversed by a first flow of fluid in a first direction and by a second flow of fluid in a second direction perpendicular to the first direction.

2. The electrical connector according to claim 1, wherein the dissipation portion has a porosity greater than or equal to 50%.

3. The electrical connector according to claim 1, wherein e conduction portion is made at least partially of metal.

4. The electrical connector according to claim 1, further comprising a core made of a first material having a first emissivity, wherein the dissipation portion comprises a passivation layer made of a second material having a second emissivity which is greater than or equal to the first emissivity.

5. The electrical connector according to claim 1, wherein each cell of the plurality of cells is connected to at least one other cell of the plurality of cells via an opening that allows a fluid to flow from one cell to the other.

6. The electrical connector according to claim 1, wherein the cells of the plurality of cells form a truncated octahedra.

7. The electrical connector according to claim 1, wherein the dissipation portion delimits a first set of cells of a first type and a second set of cells of a second type, and the cells of the first type are cylindrical with octagonal bases, while the cells of the second type are cylindrical with square bases.

8. The electrical connector according to claim 7, wherein the first set includes a plurality of first subsets of cells of the first type, and the second set includes a plurality of second subsets of cells of the second type, each first subset and each second subset having a respective intrinsic line, and the cells of each subset are arranged along the intrinsic line of the subset, and the axis of each cell is the intrinsic line.

9. A circuit breaker equipped with the electrical connector according to claim 1.

10. The electrical connector according to claim 1, wherein the dissipation portion has a porosity greater than or equal to 75%.

11. The electrical connector according to claim 1, wherein the dissipation portion has a porosity greater than or equal to 85%.

12. The electrical connector according to claim 3, wherein the conduction portion is made at least partially of aluminium.

13. The electrical connector according to claim 1, further comprising a core made of a first material having a first emissivity, wherein the dissipation portion comprises a passivation layer made of a second material having a second emissivity which is greater than the first emissivity.

* * * * *